US007861857B2

(12) United States Patent
Vorderkunz

(10) Patent No.: US 7,861,857 B2
(45) Date of Patent: Jan. 4, 2011

(54) CARRY-ON LUGGAGE WITH GARMENT HANGING FEATURE

(76) Inventor: John B. Vorderkunz, 215 Whitehall Rd., Waco, TX (US) 76712

( * ) Notice: Subject to any disclaimer, the term of this patent is extended or adjusted under 35 U.S.C. 154(b) by 279 days.

(21) Appl. No.: 11/748,244

(22) Filed: May 14, 2007

(65) Prior Publication Data

US 2008/0283350 A1 Nov. 20, 2008

(51) Int. Cl.
*A45C 13/03* (2006.01)
*A45C 13/26* (2006.01)

(52) U.S. Cl. ..... 206/289; 206/287.1; 206/292; 190/115; 190/901; 190/903

(58) Field of Classification Search ..... 190/107, 190/117, 901, 113, 903, 100, 115; 206/287, 206/279, 280, 287.1, 292, 289; 224/578
See application file for complete search history.

(56) References Cited

U.S. PATENT DOCUMENTS

| | | | | | |
|---|---|---|---|---|---|
| 1,150,057 | A | * | 8/1915 | O'Neill | 190/109 |
| 1,975,294 | A | * | 10/1934 | Sand et al. | 206/289 |
| 2,157,833 | A | * | 5/1939 | Plotkin | 190/125 |
| 2,190,707 | A | * | 2/1940 | Feldman | 190/16 |
| 3,023,867 | A | * | 3/1962 | Kotkins | 190/113 |
| 3,777,862 | A | | 12/1973 | Zipper | |
| 3,944,032 | A | | 3/1976 | Samhammer et al. | |
| 3,994,372 | A | * | 11/1976 | Geller et al. | 190/107 |
| 4,570,958 | A | | 2/1986 | Walker | |
| 4,598,803 | A | | 7/1986 | Ghiassi | |
| 4,693,368 | A | | 9/1987 | King et al. | |
| D300,689 | S | | 4/1989 | King et al. | |
| 4,966,279 | A | * | 10/1990 | Pearcy | 206/315.11 |
| RE33,794 | E | | 1/1992 | King et al. | |
| 5,501,324 | A | * | 3/1996 | Franklin et al. | 206/279 |
| 5,547,052 | A | | 8/1996 | Latshaw | |
| 5,566,797 | A | | 10/1996 | Van Himbeeck | |
| 5,575,391 | A | | 11/1996 | Gerch | |
| 5,732,817 | A | | 3/1998 | Plath | |
| 6,193,034 | B1 | * | 2/2001 | Fournier | 190/107 |
| 6,276,501 | B1 | | 8/2001 | Tong | |
| 6,883,654 | B2 | * | 4/2005 | Godshaw et al. | 190/115 |
| 7,044,277 | B2 | * | 5/2006 | Redzisz | 190/107 |
| 7,140,479 | B2 | | 11/2006 | Mangano et al. | |
| 2004/0108179 | A1 | * | 6/2004 | Scicluna et al. | 190/109 |
| 2004/0108350 | A1 | * | 6/2004 | Warren | 224/633 |
| 2006/0266603 | A1 | * | 11/2006 | Godshaw et al. | 190/108 |

FOREIGN PATENT DOCUMENTS

JP 05130910 A * 5/1993

* cited by examiner

*Primary Examiner*—Sue A Weaver
(74) *Attorney, Agent, or Firm*—Hemingway & Hansen, LLP; Eugenia S. Hansen

(57) ABSTRACT

An advantageous carry-on bag is now disclosed which accommodates hanging garments, folded garments and accessories. The bag comprises a bottom portion comprising a first bottom area and a flap area. The flap area which zips or otherwise removably secures to the top edge of each of two ends and the front side of the bag. The first bottom areas secured to the bottom edge of the two ends and the front side. When the flap is in a first position extending outwardly from said end bottom edges, it forms an area adapted to receive hanging garments. Upright flaps attached to the side edges of the end sections removably secure to one another to form a wall parallel to the front side section and define a packing area which may receive for example folded garments.

19 Claims, 5 Drawing Sheets

CARRY-ON LUGGAGE WITH GARMENT HANGING FEATURE

CROSS REFERENCE TO RELATED APPLICATIONS

Not Applicable

STATEMENT REGARDING FEDERALLY SPONSORED RESEARCH OR DEVELOPMENT

Not applicable.

TECHNICAL FIELD OF INVENTION

The invention relates to carry-on luggage that accommodates hanging suits, garments, or the like as well as items a traveler typically would transport store in a conventional suitcase.

BACKGROUND OF THE INVENTION

A typical form of transporting clothing and/or items while traveling is a suitcase, bag, or the like. Many bags allow the user to store clothes and personal items, but do not simultaneously allow for the hanging of suits, dresses, or other garments to protect them from creasing during transport. Various garment bags or hanging bags have been developed to provide transport of hanging garments. Garment bags generally have multiple compartments for holding hanging clothing and other items. However, many garment bags are large and bulky and cannot be carried onto a plane or train because they do not meet space restriction regulations. Slimmer hanging bags which may accommodate one or perhaps two suits can be carried on a plane but do not have areas to store personal items and accessories. Thus additional bags must generally be employed used to accommodate these items and the traveler may be forced to check luggage in order to meet the airline regulations.

A conventional hanging bag generally consists of a cloth or vinyl material comprising a bag that covers the hanging garments. The bag generally has an opening at one end to allow the hook of the hanger(s) on which the clothing is hung to extend outwardly from the bag. These hangers generally serve as a handle gripped by the user when carrying said bag. The hangers also can be hung on pole or in a closet while the clothing remains in said bag. It can be awkward for the user to carry the bag by the hangers since he or she may have to raise the arm up quite high to prevent clothing from dragging on the ground. Such an arm position may be awkward and undesirable. Accordingly, some users prefer to fold the bag in half over the forearm while carrying it. However, this may cause some creasing of the garments to occur and/or the hanger hooks may slip into the interior of the bag if not gripped by the user.

Garment bags or suitcases which allow the user to pack both hanging garments and other items most often must be checked rather than carried on. In addition, in a suitcase clothes must generally be folded so that items of clothing placed within are susceptible to obtaining a crease, bend, or the like. Many garment carriers often require folding the garments 180 degrees back on themselves increasing the severity of the wrinkles and creases that result.

DETAILED DESCRIPTION

Figure 1:
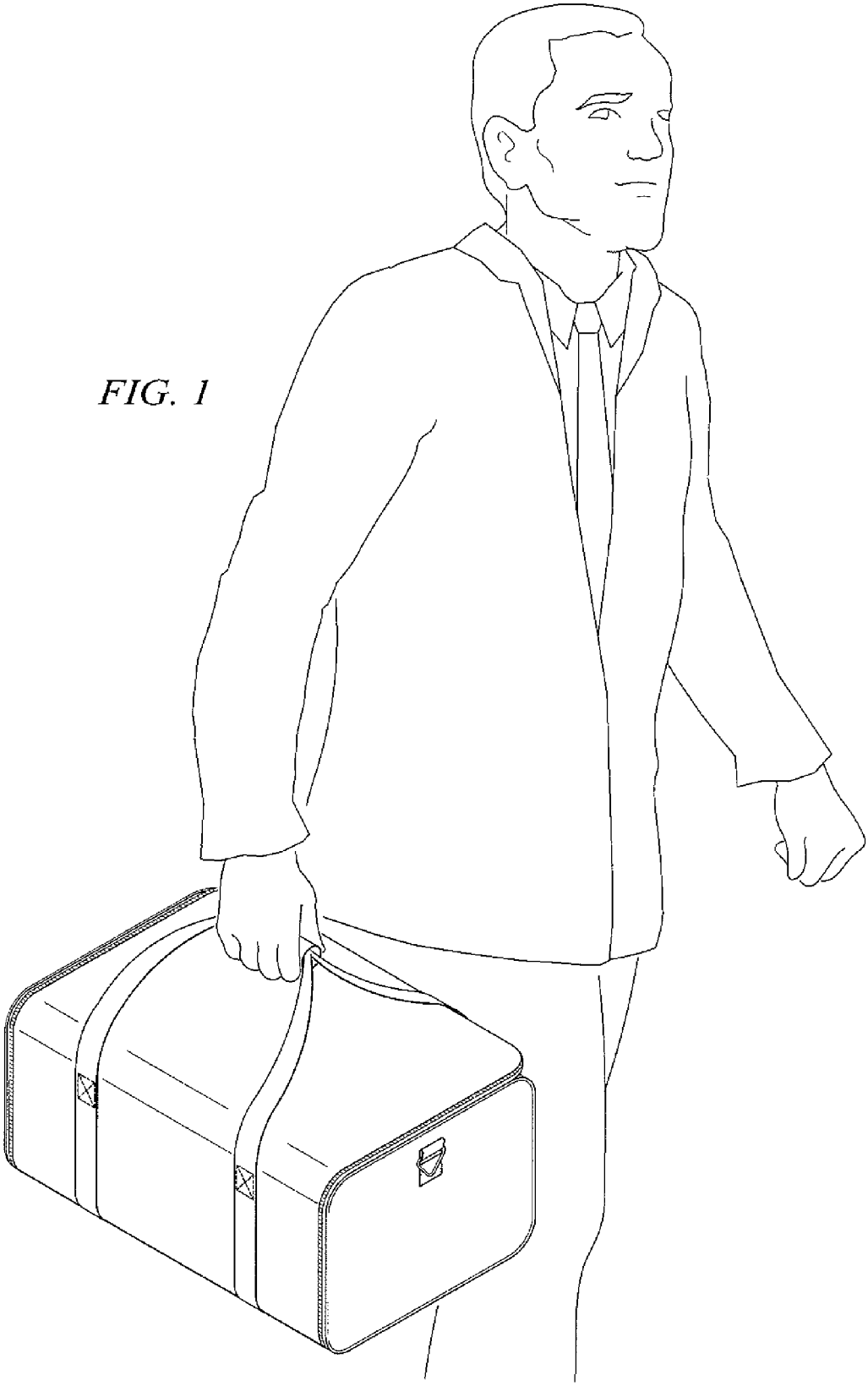
FIG. 1 is an environmental view of invention in use by traveler.

An advantageous carry-on bag is now disclosed which accommodates hanging garments, folded garments and accessories. This carry-on bag will be described in two positions, one first open position and a second closed position.

The bag comprises a front side portion which includes a closure means edge, a bottom edge and two core edges, an interior surface and an exterior surface. The front side portion may be constructed from one or more layers of soft-side luggage material. Virtually any non rigid material that can be sewn, fused or bonded is applicable. Aesthetics play an important part in the selection of the right material. Selling price and demographics of user group are also important. In an embodiment suitable for most users, a durable woven material made from natural or synthetic fibers is desirable. Another embodiment employs simulated leathers made from, for example, polyvinyl chloride or polyurethane. Yet another embodiment employs genuine leather. In many situations a combination of all materials would be desirable.

In its preferred use mode, the front side portion is positioned essentially upright (essentially perpendicular with respect to vertical). In a preferred embodiment, the front side portion further comprises a second layer of material secured to at least a portion of the first layer, forming a pocket. The first layer defines an opening through which the pocket may be accessed from the outside of the bag. A closure means is preferably attached adjacent said opening so that access to the pocket is available when the closure means is in a first access position and access is not available when the closure means is in a second access position. An example of suitable closure means are zippers, hook and loop fasteners such as Velcro brand fasteners, snaps and the like. Preferably, a zipper is secured about the opening to permit access when the zipper is in an unzipped position and no access when the zipper is closed. Alternatively, a flap may be secured to the exterior surface of the front side portion adjacent said opening having a flap exterior surface and a flap interior surface. A fastener such as snaps or hook or loop strips may be secured to the flap interior surface and a complementary fastener may be secured adjacent said opening to the exterior surface of said front side portion. The flap then will secure the opening in said front side portion.

In another embodiment, the second layer defines an opening through which the pocket may be accessed from the inside of the bag. A closure means is preferably attached adjacent said opening so that access to the pocket is available when the closure means is in a first access position and access is not available when the closure means is in a second access position. The details of the closure alternatives are described above with respect to the pocket that may be accessed from the exterior or the bag and the same alternatives may be applied to a pocket accessible from the interior of the bag.

Alternatively, the front side portion may optionally comprise one or more independent pockets secured to the interior surface which may be composed of mesh, soft material, vinyl, water proof or other suitable materials which will accommodate smaller items. Securing of the independent pockets can be accomplished through any means, with the following being preferred: snaps (plastic or metallic), separating zippers or hook and loop (Velcro-type) fasteners. Most preferably, an independent pocket is provided which has a slim profile, zipper access, and is permanently secured to the interior surface.

The front side preferably further comprises a first portion of a handle assembly secured to two areas of the exterior surface. Securing the handle is best accomplished by sewing, ultrasonic fusing, or high frequency welding. The straps and handles are preferably comprised of woven webbing, extruded polymers or natural or synthetic leather. "The areas where the handle is secured may be reinforced with "box x" stitching and a patch of simulated leather used as backing. Considering the fixed dimensions of the bag the only requirement regarding the length of the handles or straps is that they meet at top dead center with adequate hand clearance of comfort, approximately 4 to 6 inches with handles joined at top dead center. A loop-type handle is thus formed. A second portion of a handle assembly is secured to another portion of the bag and will be described further below. If a pocket accessible from the exterior is provided, the handle is will be secured so as to not interfere with access thereto. The loop-type handle is of a finished length so to allow a user to carry the bag a comfortable distance from the ground.

The bag further comprises two end portions which each include an end bottom edge, an end front edge, and a closure means edge, an interior surface and an exterior surface. Each end portion is connected to one of the core edges of the front side portion. This is accomplished by securing said end front edges to the core edges of front side portion to form core secured edges. The securing is preferably accomplished by sewing or a variant involving ultrasonic fusing or high frequency welding. In use, the end portions will be essentially upright (essentially perpendicular with respect to vertical). Optionally, a hook or loop may be secured to the exterior surface of the end portion. A removable shoulder strap may be attached to said loop, and other items such as luggage identification tags may also be attached to the hook or loop.

The bag further comprises a bottom portion. The bottom portion has two short edges which secure to said end bottom edges to form end secured edges and a long edge which secures to said bottom edge to form a front side secured edge. The preferred method of securing these edges is sewing, as described above. These secured edges along the bottom portion define a first area of the bottom portion which lays flat when in use.

A clasp is attached to said bottom portion or adjacent said bottom portion to receive hanger hooks to help secure garments in place. An area of said bottom portion may be reinforced with a patch of either natural or simulated leather backing and the clasp sewn thereto. Preferably, a loop tab made of a strong material such as natural or synthetic webbing, natural or simulated leather is sewn between said side portion and said bottom portion of the bag along said first area of said bottom portion and the clasp sewn thereto.

Contiguous with said first area of said bottom portion, the bottom portion further comprises a flap area that extends outwardly from said end portions when said bag is in said first open position. The flap area comprises a first flap layer and a second flap layer. The first flap layer has a continuous edge comprising two long sections opposite one another and one short section between said long sections.

The second flap layer is composed of a first half and a second half. The second flap layer overlays said first flap layer and has side long edges and center long edges. The side long edges are secured to said first area of said bottom portion and said long edges of said first flap layer. The first half and the second half are removably connected by a closure means secured to said center long edges. A preferred closure means is a separating zipper which will permit said center long edges to be attached when the zipper is closed and not attached when the zipper is opened and separated. Other closure means may be used such as plastic or metal snaps, or hook and loop fasteners, such as Velcro. These may be used to secure the second flap layer—in such an event the flaps would overlap by a distance equal to the width of the closure device plus ¼".

The continuous edge of the first flap layer comprises a closure means complementary to said closure means edges of said end and front side portions. The closure means is preferably a zipper of any size which can provide the desired function of securing the first flap layer continuous edge to the closure means edges of the end and side portions, taking into account the nature of the material from which these components are fabricated. Most preferably, a zipper of Size #7 or greater is employed.

Secured to said end portions adjacent the closure means edge of each end portion are upright flaps which in use are parallel to the front side of the bag. Each upright flap has an edge opposite the attachment to the end portions which comprises a closure means complementary to the closure means on the other upright flap. These flaps are removably attachable to one another and when attached form a wall which defines a packing area. The first area of the bottom portion and a part of the second flap layer of the bottom portion underlie the packing area in use, forming a floor thereto . . . This packing area is further defined by both end portions, the front side portion.

By joining the continuous edge closure means and the closure means of said end and front side portions, said second closed position is achieved. For purposes of security and strength, a zipper is used for the closure means in a preferred embodiment. While it may be envisioned that other closure means can be used, such as hook and loop, snaps etc, the zipper provides a good and secure means of closure. The zipper method, of proper size, provides the most advantageous combination of strength and flexibility to provide a continuous and secure closure, especially at the corners. The zipper may be attached by means of stitching, ultrasonic fusing or high frequency welding. Most preferably, a zipper of Size 7 or greater is used.

For bag to be suitable for carry-on an airplane or train, a bag must adhere to specific dimensional requirements. According to typical airline standards, carry-on luggage must generally be at or below about 45 inches (sum of the length, width and height) to be permitted in the passenger area of the plane . . . For example, a typical carry-on bag is around 22 inches by 9 inches.

The fold out flap (comprising two layers of said bottom portion as described above) should be long and wide enough to accommodate a typical hanging garment. The length of the fold out flap is preferably essentially equal to the height plus the width of either of the end portions of the bag. The width of the fold out flap is preferably essentially equal to the width of the top portion.

Preferred closure means include zippers. Alternative closure means include hook and loop such as Velcro brand closures, buttons, snaps or other means known to the art. Any of these acceptable closures may be used in the interior of the bag such as for example the upright flaps and interior pockets. Closure means other than zippers are not preferred for joining the continuous edge with the end and front side edges for need of complete and full closure to fully secure all internal items.

When closure means other than zippers are used in places, for example the flaps, flaps must be made longer to allow flap ends to overlap.

Preferably, the bag is light weight and is constructed of such materials as 2000 denier Nylon, known in trade as ballistic nylon, or 1200-1500 denier polyester fabric. Variations for specific applications could include Nomex, Kevlar, genuine and/or synthetic leather, and other natural or synthetic woven fibers. However, any material known to the trade which can be fashioned into the component parts, or combinations of materials, can be used to make components of the bag.

The other loop-type handle is to be of length which conforms to the dimension range specified above, and is to be attached in a similar manner; i.e. through stitching, ultrasonic fusing, or high frequency welding.

In use, a traveler can open the bag by unzipping the zipper between the bottom flap and the end and front side portions. The bottom flap will then lay down flat. If the upright flaps are connected to one another, they can be unfastened. The two halves of the second flap layer can be separated from one another by unfastening the connecting means that removably attaches them together. This will reveal the bottom layer of the bottom flap and the clasp attached thereto or to a loop tab which extends onto the bottom flap. The user can then place his or her clothing on hangers onto the bottom layer by, for example, hooking the hooks of conventional hangers onto the clasp. The clasp may be adapted to temporarily secure other types of hangers that may be adapted therefor. The traveler can then join the two halves of the second flap layer via the connecting means. The preferred connecting means, the separating zipper, is for example put together at the bottom and zipped up. The upright flaps can then be fastened together to define the packing area. The user can then place stacks of clothing such as folded shirts, sweaters and the like into the packing area. When finished packing, the user can fold over the bottom flap so that the proximal end is near the front side portion. The bag can then be zipped, thus securing the bottom flap to the ends and front side portions. The user can then pick up the bag by the handles, which keeps the stacks of clothing in the packing area in the same position as when he or she packed them. The bag containing both hanging garments and other packed items can be carried onto the plane or train and placed in the overhead bin or under the seat, with the clothing still maintaining the original packed position.

The bag is appropriate not only for light business travel, it also performs well as a gym bag for working professionals and students who exercise during the work day All Figures shown illustrate the preferred embodiment of the carry-on bag luggage with garment hanging features.

Referring now to FIG. 1, the preferred embodiment carry-on bag in its second closed position is shown in use by a traveler. With the handles (5A & 5B) strategically attached to side portions (52 & 54), the bag may be lifted and carried, advantageously permitting packed clothing, as shown in FIG. 5, to stay in the orientation in which it was placed in the luggage. The traveler is also able to carry hanging garments in bag as will be best seen in FIG. 4, and thus has a single convenient carry-on bag able to accommodate the needs of a typical business traveler who transports a suit, one or more shirts, sleepwear, underwear, and toiletries.

Figure 2:
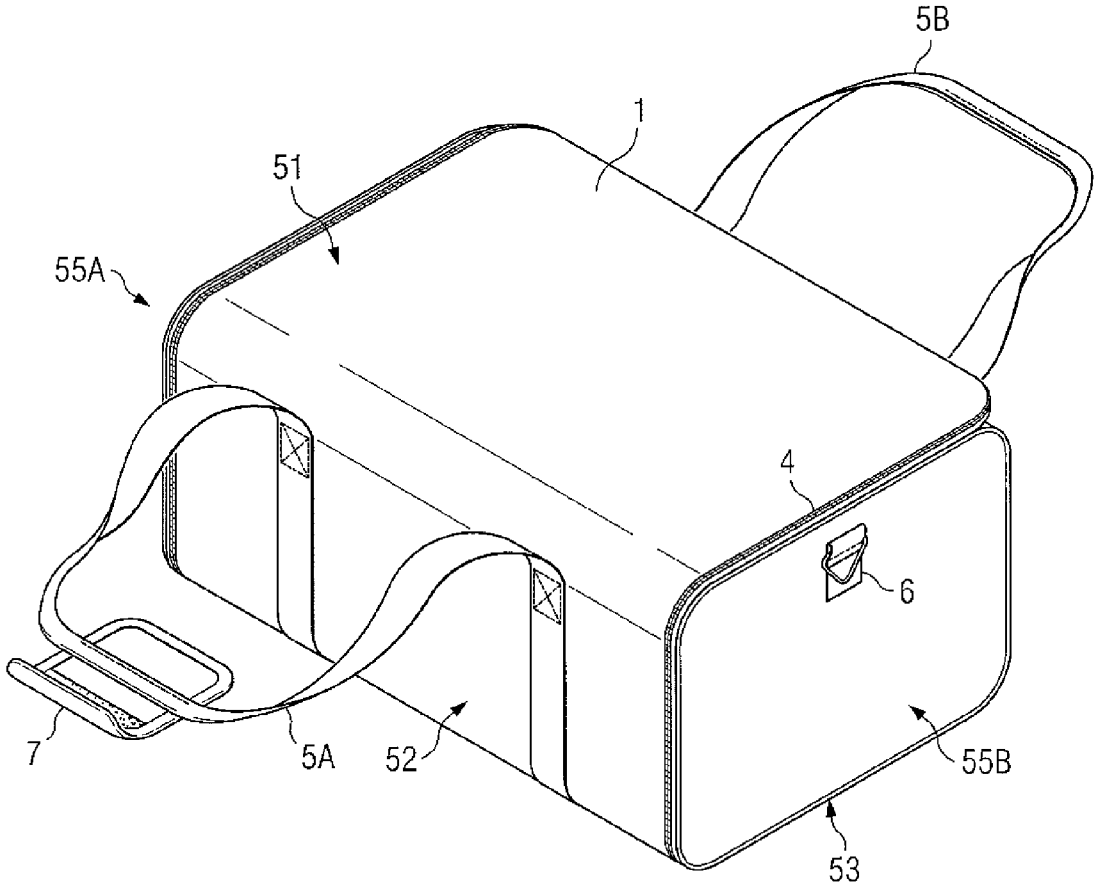
FIG. 2 is a three dimensional perspective of the luggage piece in its second closed position.
Figure 3:
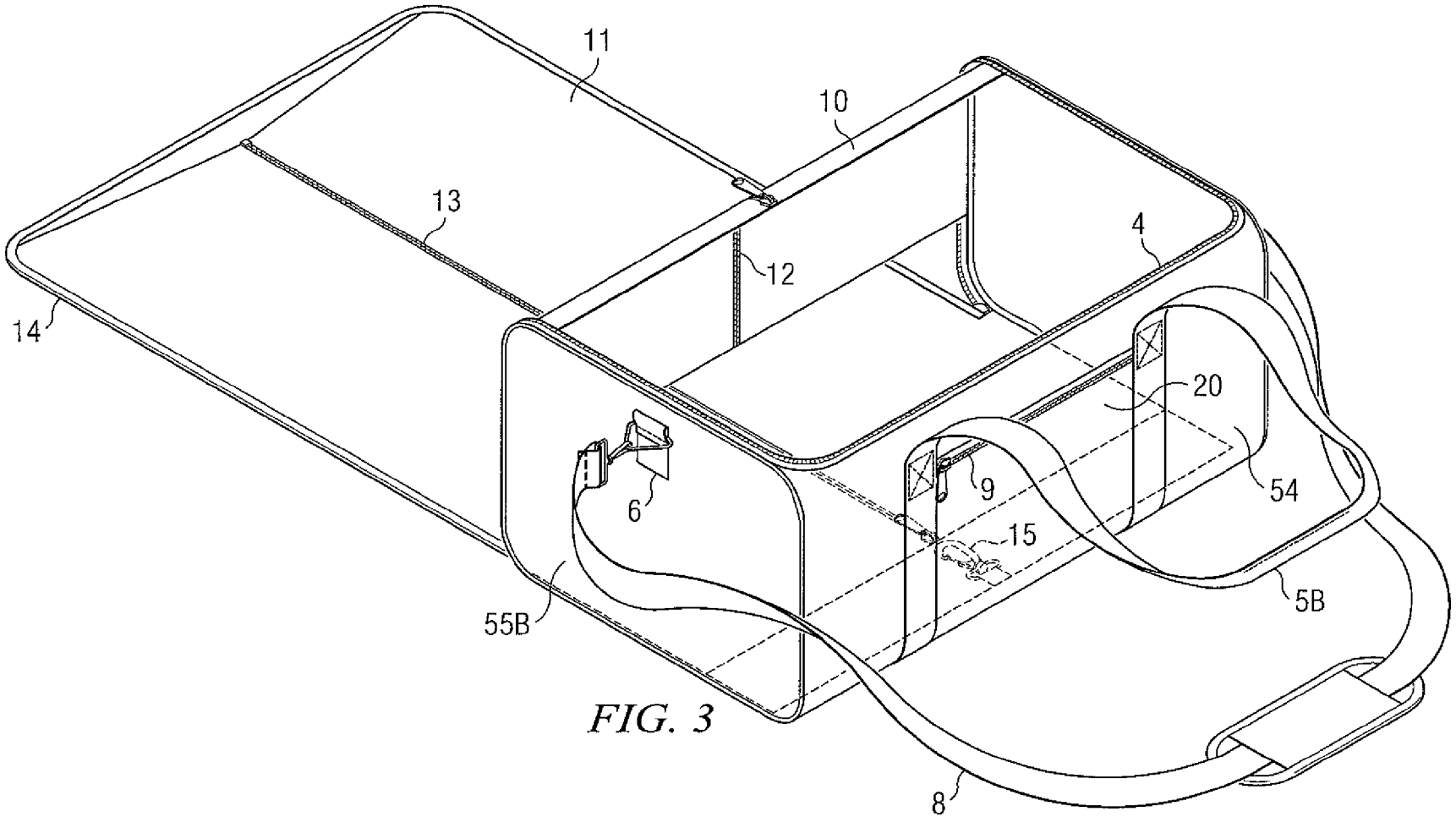
FIG. 3 illustrates the invention in its first open position.

As shown in FIGS. 2 and 3 in the first open position, the preferred embodiment includes a front side portion (54), two end portions (55A & 55B), and a bottom portion (1), which is comprised of the top portion (51), the back side portion (52), and the first area of bottom portion (53). Attached to each side portion (52, 54) is a handle (5A & 5B). A joining flap (7) allows both handles to be joined for easier carrying. Attached to each end portion (55) is a hook or loop (6) to which a removable shoulder strap (8) may be connected. The front side portion (54) contains an outside pocket (20) between the handle (5B) ends and given access by outside zipper (9).

Access to interior of luggage piece is provided by unfastening zippers (4, 14) in which bottom portion (1) unfolds until flat with first area of bottom portion (53) to rest in its first open position as seen in FIG. 3.

Figure 4:
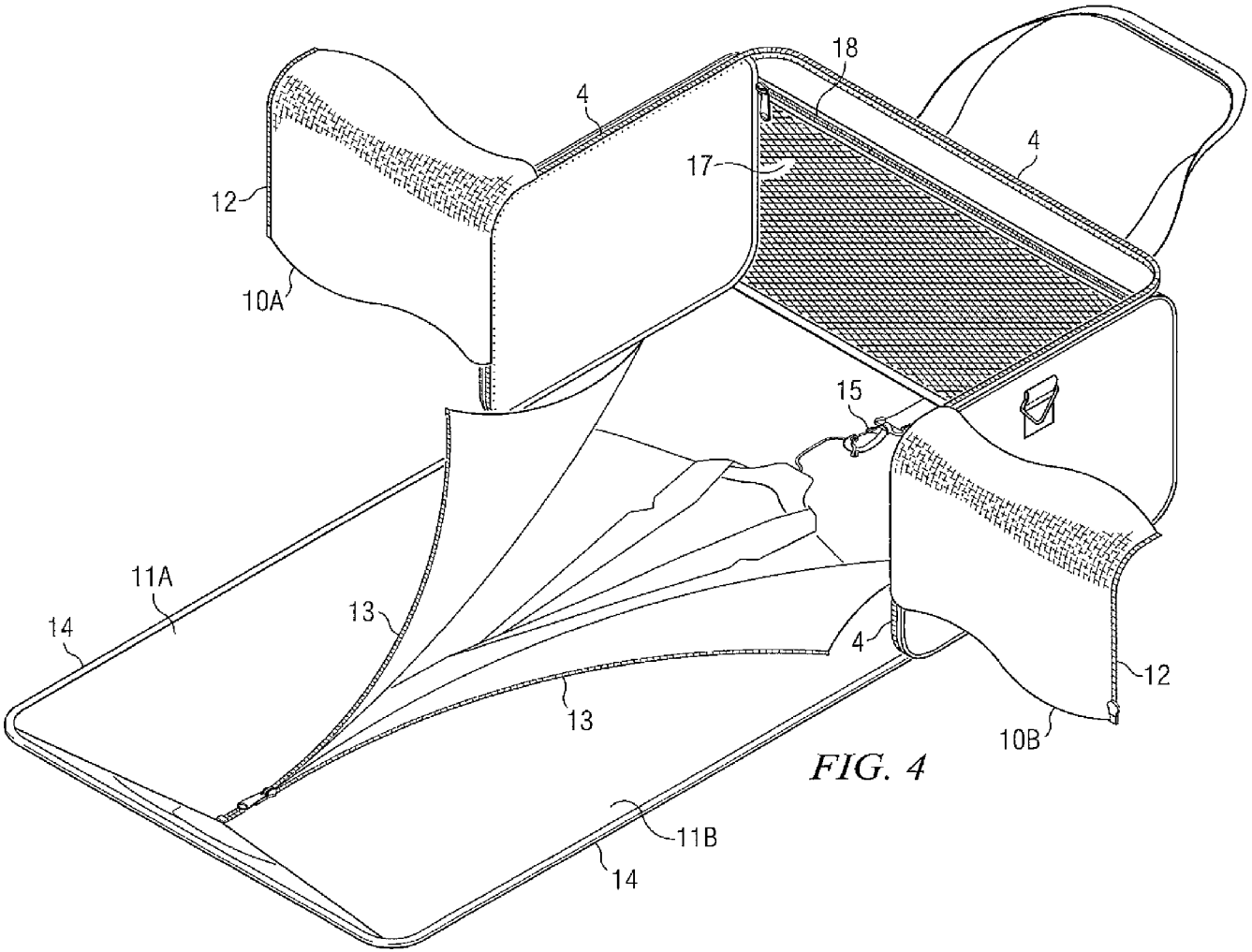
FIG. 4 is an illustration of the invention in a first open position with garment bag feature in use.
Figure 5:
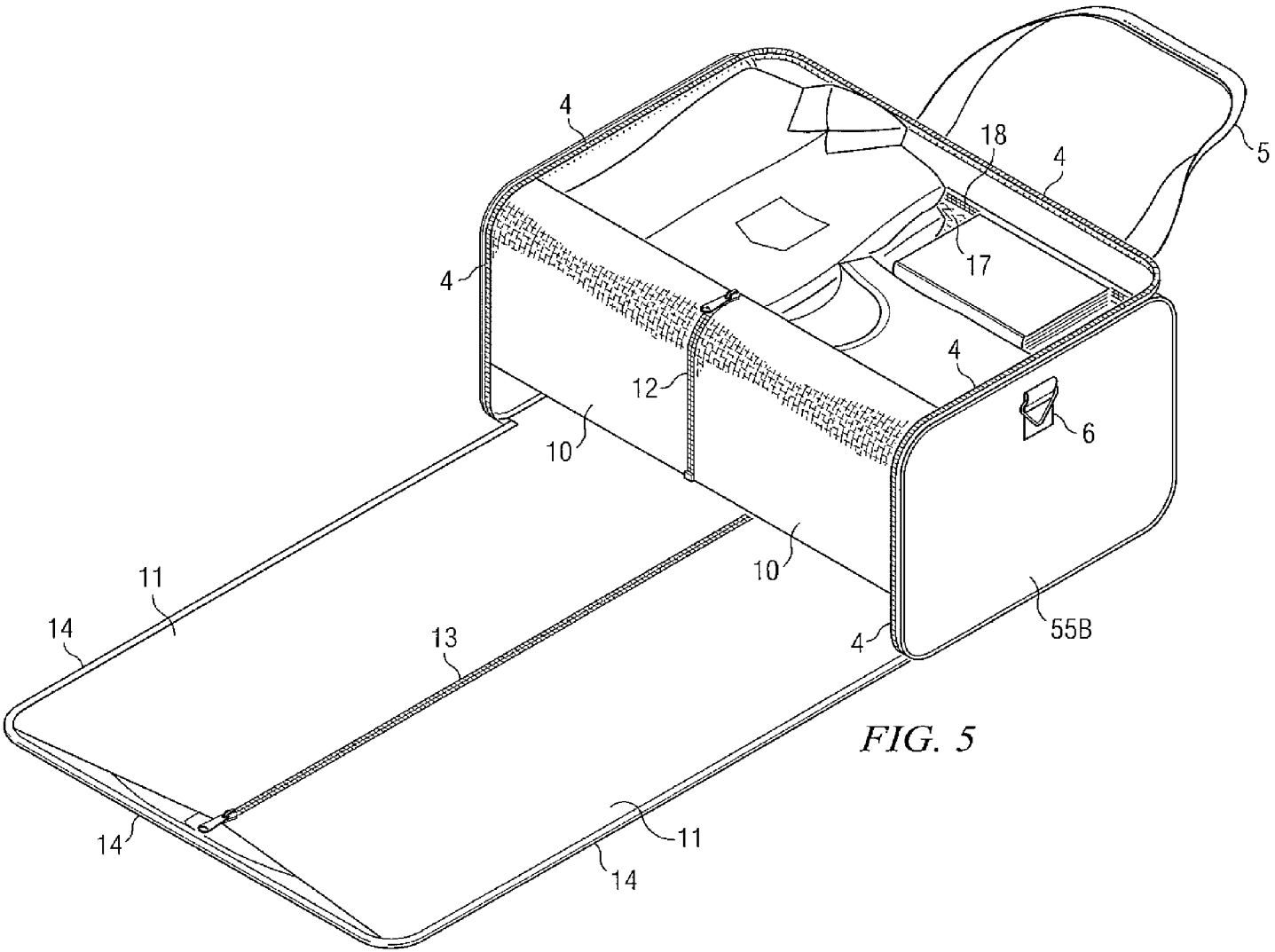
FIG. 5 is an illustration of the invention in first open position with stored items.

Referring now to FIG. 4, perpendicular flaps (10A & 10B) may be removably secured by a securing zipper (12) to form a substantially upright wall (10), as best seen in FIGS. 3 and 5. When securing zipper (12) is fully unzipped, perpendicular flaps (10A & 10B) may be parted as a requirement for access to the parallel flaps 11A & 11B. (11A & 11B) are removably secured to each other by means of a connecting flap zipper (13). Suits or garments may be placed on a hanger and hung on clasp (15) to help secure the suits, garments, or the like in place. Parallel flaps (11A & 11B) may then be fastened together by the connecting flap zipper (13) to secure suits and/or garments in place. Perpendicular flaps (10A & 10B) may be fastened together by the securing zipper (12) to form a substantially upright wall and thus create a storage compartment wherein clothes and items may be stored. An inside pocket (17) is found along the interior of front side portion (54) for extra storage. This pocket is removably secured by inside zipper (18).

FIG. 5 illustrates the preferred embodiment with suits and/or garments secured beneath the parallel flaps (11A & 11B) by the connecting flap zipper (13), and the perpendicular flaps (10A & 10B) secured by the securing zipper (12) to create substantially upright wall where by a compartment is created to allow for stored clothes and/or items.

When the second closed position or secure embodiment is desired for transporting the bag, the bottom portion (1) folds up with the back side portion (52) placed along side of perpendicular flaps (10A & 10B) and top portion (51) placed above compartment opening of compartment created by fastening of perpendicular flaps (10A & 10B) by the securing zipper (12). Top and back side portions (51 & 52) are then secured to end and front side edges by fastening the end and front side edge zippers (4) to the continuous edge zipper (14), resulting in the second closed position embodiment shown in FIG. 2.

I claim:

1. A carry-on luggage bag, having a first open position and a second closed position, comprising:

(a) a front side portion made of non-rigid material having a front side closure means edge, a bottom edge, two core edges, and an inner side and an outer side;

(b) two end portions made of non-rigid material, each having an end bottom edge, an end front edge and an end closure means edge, each of said end front edges secured to one of said core edges of said front side portion to form core secured edges;

(c) a bottom portion made of non-rigid material having two short edges, one of said short edges secured to one of said end bottom edges and the other of said short edges secured to the other of said end bottom edges to form end secured edges;

a long edge secured to said bottom edge of said front side portion to form a front side secured edge;

said end secured edges and said front side secured edge defining a first area of said bottom portion;

a first flap layer having an inner side and an outer side, being contiguous with said first area of said bottom portion and extending outwardly from said end portions when said bag is in said first open position, said first flap layer having a continuous edge comprising two long sections opposite one another and one short section between said two long sections, said continuous edge secured to a continuous edge closure means complementary to said closure means edges of said end and front side portions;

whereby said continuous edge closure means of said first flap layer may be secured to said complementary end and front side closure mean edges thereby forming said second closed position of said carry on luggage bag;

(d) a garment receiving area defined by said first flap layer and a second flap layer overlaying said first flap layer of said bottom portion and secured to said first area of said bottom portion and said long sections of said first flap layer, said second flap layer having a first portion and a second portion, said first portion and said second portion removably connected to each other by a closure means;

said garment receiving area further comprising a clasp secured thereto, said clasp adapted to receive and temporarily secure hangers for hanging clothing along a line perpendicular to said front side closure means edge and said short section of said first flap layer;

(e) a packing area defined by said first area of said bottom portion, said two end portions and said front side portion, wherein said end portions and said front side portion remain essentially perpendicular to said first area of said bottom portion; and (f) handles attached to said outer side of said front side portion and to said outer side of said first flap layer which allow a user to maintain said luggage in an orientation during use so that said bottom portion is essentially parallel with the ground.

2. The bag of claim 1, further comprising two upright flaps, in reference to the bottom portion, each having a first end and a second end, said first end of each upright flap secured to one of said end portions of said bag, said second end of each upright flap attached to a closure means portion complementary to a closure means portion on the other upright flap second end, whereby said upright flaps may be removably attached to one another, whereby when said upright flaps are attached a wall is formed essentially enclosing said packing area.

3. The bag of claim 1, further comprising a hook or loop attached to each end portion to which a removable shoulder strap may be connected.

4. The bag of claim 1, wherein said front side portion further comprises an outside pocket on said outer side wherein said outside pocket comprises a storage area and a closure means.

5. The bag of claim 1, wherein said handle attached to said outer side of said front side portion is a loop-type handle secured at two locations and an outside pocket is located between said two locations.

6. The bag of claim 1, wherein said front side portion further comprises an inside pocket on said inner side wherein said inside pocket has a closure means.

7. A carry-on luggage bag, having a first open position and a second closed position, comprising:

(a) an essentially rectangular front side portion made of non-rigid material having a front side zipper edge, a bottom edge, two core edges, an inner side and an outer side;

(b) two end portions made of non-rigid material, each having an end bottom edge, an end front edge and an end zipper edge, each of said end front edges secured to one of said core edges of said essentially rectangular front side portion to form core secured edges;

(c) a bottom portion made of non-rigid material having two short edges, one of said short edges secured to one of said end bottom edges and the other of said short edges secured to the other of said end bottom edges to form end secured edges;

a long edge secured to said bottom edge of said essentially rectangular front side portion to form a front side secured edge;

said end secured edges and said front side secured edge defining a first area of said bottom portion;

a first parallel flap layer having an inner side and an outer side, being contiguous with said first area of said bottom portion and extending outwardly from said end portions in an essentially flat configuration when said bag is in said first open position, said first parallel flap layer having a continuous edge comprising two long sections parallel to one another and one short section between said two long sections, said continuous edge secured to a zipper portion complementary to said zipper edges of said end and front side portions;

whereby said continuous edge zipper of first parallel flap layer may be zipped to said complementary end and front side zipper edges thereby forming said second closed position of said carry on luggage bag;

(d) a garment receiving area defined by said first parallel flap layer and a second parallel flap layer overlaying said first parallel flap layer of said bottom portion and secured to said first area of said bottom portion and said long sections of said first parallel flap layer, said second parallel flap layer having a first portion and a second portion, said first portion having a closure means and said second portion having a closure means which removably connects to said closure means on said first portion, whereby said first portion and said second portion can be removably joined to one another;

said garment receiving area further comprising a clasp secured thereto, said clasp adapted to receive and temporarily secure hangers for hanging clothing along a line perpendicular to said front side zipper edge and said short section of said first parallel flap layer;

(e) a packing area defined by said first area of said bottom portion, said two end portions and said front side portion, wherein said end portions and said front side portion remain essentially perpendicular to said first area of said bottom portion;

(f) two upright flaps, in reference to the bottom portion, each having a first end and a second end, said first end of each upright flap secured to one of said end portions of said bag, said second end of each upright flap attached to a closure means portion complementary to a closure means portion on the other upright flap second end, whereby said upright flaps may be removably attached to one another, whereby when said upright flaps are attached a wall parallel to said front side portion of said bag is formed essentially enclosing said packing area; and (g) handles attached to said outer side of said front side portion and said outer side of said first parallel flap layer which allow a user to maintain said luggage in an orientation during use so that said bottom portion is essentially parallel with the ground.

8. The bag of claim 7, further comprising a joining flap attached to one of said handles which allows both handles to be joined for easier carrying.

9. The bag of claim 7, further comprising a hook or loop attached to each end portion to which a removable shoulder strap may be connected.

10. The bag of claim 7, wherein said front side portion further comprises an outside pocket on said outer side wherein said outside pocket comprises a storage area and a closure means.

11. The bag of claim 10, wherein said handle on said front side portion is a loop-type handle secured at two locations to said front side portion and said outside pocket is located between said two locations where said handle is secured.

12. The bag of claim 7, wherein said front side portion further comprises an inside pocket on said inner side.

13. A carry-on luggage bag, having a first open position and a second closed position, comprising:

(a) an essentially rectangular front side portion made of non-rigid material having a front side zipper edge, a bottom edge, two core edges, an inner side and an outer side;

(b) two end portions made of non-rigid material, each having an end bottom edge, an end front edge and an end zipper edge, each of said end front edges secured to one of said core edges of said essentially rectangular front side portion to form core secured edges;

(c) a bottom portion made of non-rigid material having two short edges, one of said short edges secured to one of said end bottom edges and the other of said short edges secured to the other of said end bottom edges to form end secured edges;

a long edge secured to said bottom edge of said essentially rectangular front side portion to form a front side secured edge;

said end secured edges and said front side secured edge defining a first area of said bottom portion;

a first parallel flap layer having an inner side and an outer side, being contiguous with said first area of said bottom portion and extending outwardly from said end portions in an essentially flat configuration when said bag is in said first open position, said first parallel flap layer having a continuous edge comprising two long sections parallel to one another and one short section between said two long sections, said continuous edge secured to a zipper portion complementary to said zipper edges of said end and front side portions;

whereby said continuous edge zipper of first parallel flap layer may be zipped to said complementary end and front side zipper edges thereby forming said second closed position of said carry on luggage bag;

(d) a garment receiving area defined by said first parallel flap layer and a second parallel flap layer overlaying said first parallel flap layer of said bottom portion and secured to said first area of said bottom portion and said long sections of said first parallel flap layer, said second parallel flap layer having a first portion and a second portion, said first portion and said second portion removably connected to each other by a zipper;

said garment receiving area further comprising a clasp secured thereto, said clasp adapted to receive and temporarily secure hangers for hanging clothing along a line perpendicular to said front side zipper edge and said short section of said first parallel flap laver;

(e) a packing area defined by said first area of said bottom portion, said two end portions and said front side portion, wherein said end portions and said front side portion remain essentially perpendicular to said first area of said bottom portion;

(f) two perpendicular flaps each having a first end and a second end, said first end of each perpendicular flap secured to one of said end portions of said bag, said second end of each perpendicular flap attached to a securing zipper portion complementary to a securing zipper portion on the other perpendicular flap second end, whereby said perpendicular flaps may be removably attached to one another, whereby when said perpendicular flaps are attached a wall parallel to said front side portion of said bag is formed essentially enclosing said packing area;

(g) handles attached to said outer side of said front side portion and said outer side of said first parallel flap layer which allow a user to maintain said luggage in an orientation during use so that said bottom portion is essentially parallel with the ground;

and (h) one or more pockets located on said outer side of said front side portion wherein said one or more pockets comprise an outside pocket closure means.

14. The bag of claim 13, further comprising a hook or loop attached to each end portion to which a removable shoulder strap may be connected.

15. The bag of claim 13, wherein said non rigid material is capable of being sewn, fused or bonded.

16. The bag of claim 15, wherein said non rigid material is 2000 denier Nylon.

17. The bag of claim 15, wherein said non rigid material is 1200-1500 denier polyester fabric.

18. The bag of claim 13, wherein said bag is fabricated from a natural animal hide.

19. The bag of claim 13, wherein said bag is fabricated from synthetic material.

* * * * *